United States Patent [19]

Wilson

[11] 4,078,520

[45] Mar. 14, 1978

[54] VIBRATING SCREEN FILTER FOR TONER DENSITY MEASURING APPARATUS

[75] Inventor: Clement B. Wilson, Webster, N.Y.

[73] Assignee: Xerox Corporation, Stamford, Conn.

[21] Appl. No.: 802,617

[22] Filed: Jun. 2, 1977

[51] Int. Cl.[2] ..... G03G 15/06

[52] U.S. Cl. ..... 118/646

[58] Field of Search ..... 118/646, 7, 653; 222/DIG. 1

[56] References Cited

U.S. PATENT DOCUMENTS

| | | | |
|---|---|---|---|
| 3,528,386 | 9/1970 | Morine | 118/7 |
| 3,621,816 | 11/1971 | Donalies | 118/653 X |
| 3,727,065 | 4/1973 | Maksymiak | 118/646 X |
| 3,941,470 | 3/1976 | Shah | 118/646 X |

*Primary Examiner*—Louis K. Rimrodt
*Assistant Examiner*—Andrew M. Falik
*Attorney, Agent, or Firm*—Earl T. Reichert

[57] ABSTRACT

If developer within a xerographic developing apparatus becomes excessively charged, excessive toner is added to the apparatus because the excessively charged developer prevents a sensor from sensing the actual toner density within the apparatus. This occurs because a screen above the sensor becomes clogged by developer and prevents developer from passing through the screen and consequently the sensor. To prevent this clogging an AC coil is connected to the screen to vibrate the latter, thus allowing developer to pass through the screen and sensor.

2 Claims, 1 Drawing Figure

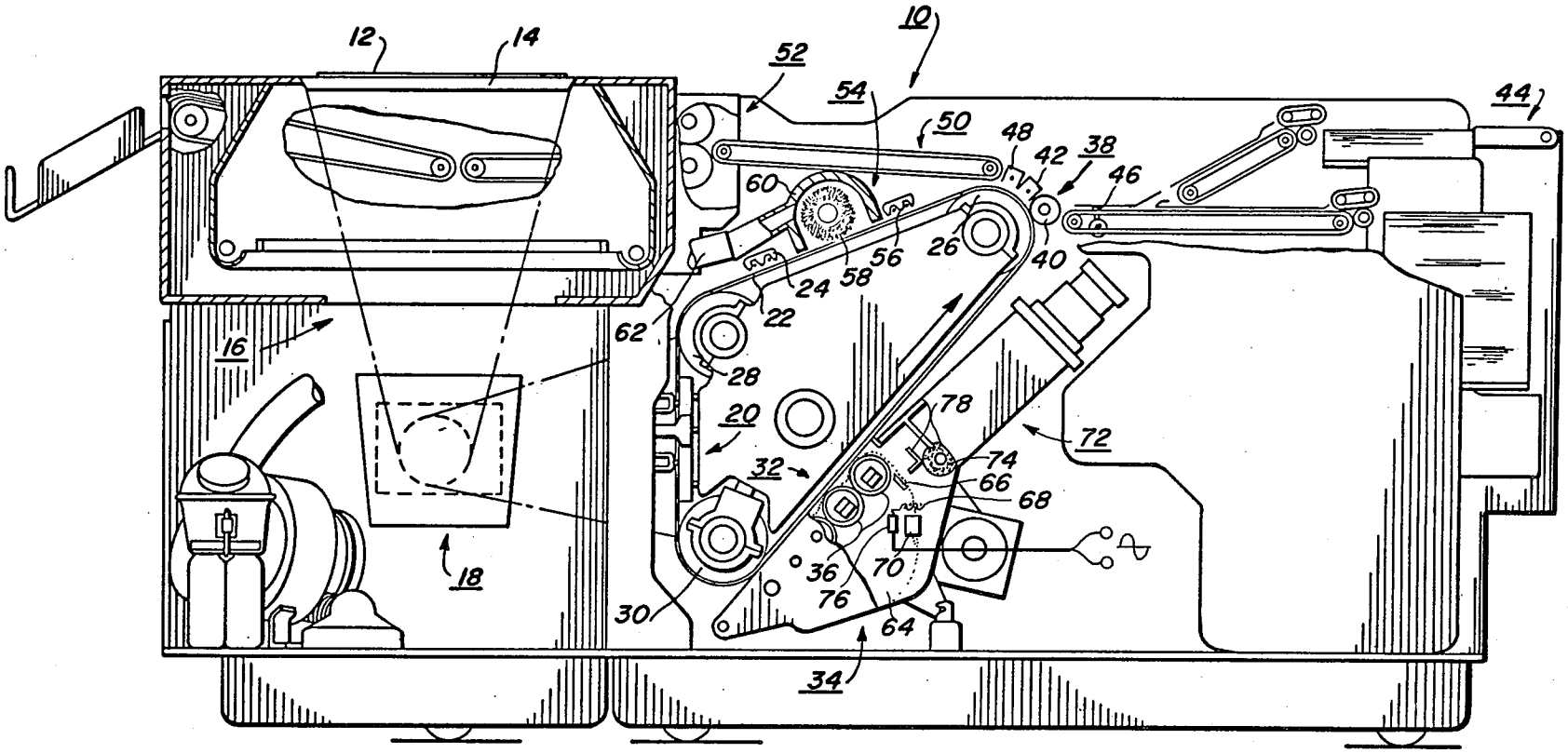
10
12
14
16
18
20
22
24
26
28
30
32
34
36
38
40
42
44
46
48
50
52
54
56
58
60
62
64
66
68
70
72
74
76
78

VIBRATING SCREEN FILTER FOR TONER DENSITY MEASURING APPARATUS

BACKGROUND OF THE INVENTION

The present invention relates to an improved developing apparatus for an electrostatic reproduction machine.

In conventional xerography, a xerographic plate (photoreceptor) comprising a layer of photosensitive insulating material affixed to a conductive backing is used to support electrostatic latent images. In the xerographic process, the photosensitive surface is electrostatically charged, and the charged surface is then exposed to a light pattern of the image being reproduced to thereby discharge the surface in the areas where light strikes the surface. The undischarged areas of the surface thus form an electrostatic charge pattern (an electrostatic latent image) conforming to the original pattern. The latent image is then developed by contacting it with a finely divided electrostatically attractable powder referred to as "toner". Toner is held on the image areas by the electrostatic charge on the surface. Where the charge is greater, a greater amount of toner is deposited. Thus, a toner image is produced in conformity with a light image of the copy being reproduced. Generally, the developed image is then transferred to a suitable transfer member (e.g., paper) and the image is affixed thereto to form a permanent record of the original document.

In the practice of xerography, the transfer member is caused to move in synchronized contact with the photoreceptor surface during the transfer operation, and an electrical potential opposite from the polarity of the toner is applied to the side of the paper remote from the photoreceptor to electrostatically attract the toner image from the photoreceptor to the paper.

A modern high speed duplicating machine uses a developing apparatus having magnetic brushes to transport developer (carrier plus toner) from a developer sump to the photoreceptor to develop the latent image. Toner is periodically dispensed into the developer sump by a toner dispensing device, the latter being actuated by a sensor and control means in accordance with the sensed density of toner alternately deposited on either of two attracting elements. The amount of useful toner particles in the developer can be determined by the amount that will be alternately deposited upon the elements, each being charged with a voltage to set up the proper field between the elements. This toner determination is utilized to control the amount of active toner within the apparatus. The sensor, having two elements each capable of carrying a charge placed thereon, is positioned within the apparatus to receive some of the developing material falling between the elements. Potentials are alternately placed upon the elements cyclically, thereby reversing the electric field between the elements cyclically. This causes toner to be attracted to and cleaned from the elements cyclically. While one element is provided with an attracting field, the other element serves as a developing electrode for the solid area development of the attracting element since the electric field between the elements will be uniform. The amount of toner attracted to each element when it is charged to attract toner for any particular period of time is related to or a function of the developability in the developer apparatus. The elements are connected in an electrical circuit which produces a steady state signal set for optimum condition and which, when deviated from a preset level, generates a control signal introducing toner particles into the developer sump. Such a sensor and control means is thoroughly described in U.S. Pat. No. 3,727,065 assigned to Xerox Corporation, the disclosure of this patent being incorporated by reference herein.

Included in the above described developing apparatus is a screen through which the developer passes before reaching the sensor, the screen separating contaminates from the developer before the latter reaches the sensor. One of the problems with this arrangement is that the screen becomes clogged with developer after only a few thousand copies are made. When the screen becomes clogged, very little or no developer reaches the sensor, and this causes the sensor to actuate the toner dispenser an excessive amount. Consequently, an excessive amount of toner is dispensed into the developer sump, and this eventually causes the machine to go into a failure mode in which copy quality deteriorates, the machine cleaning system fails, photoreceptor filming occurs, etc. This problem is magnified when a duplicating machine is operating in areas of low humidity.

SUMMARY OF THE INVENTION

A primary object of the present invention is to prevent the screen above the sensor from becoming clogged so that the sensor senses the actual toner density within the developing apparatus.

BRIEF DESCRIPTION OF THE DRAWING

The FIGURE is a schematic sectional view of an electrostatic reproduction machine embodying the principles of the present invention.

DETAILED DESCRIPTION OF THE INVENTION

For a general understanding of an electrostatic reproduction machine in which the present invention may be incorporated, reference in made to FIG. 1. As in all electrostatic reproduction machines of the type illustrated, a light image of an original is projected onto the photosensitive surface of a xerographic plate to form an electrostatic light image thereon. Thereafter, the latent image is developed with developer comprising carrier beads and toner particles triboelectrically adhering thereto to form a xerographic powder image corresponding to the latent image on the photosensitive surface. The powder image is then electrostatically transferred to a transfer member such as a sheet of paper to which it may be fixed by a fusing device whereby the toner image is caused permanently to adhere to the transfer member.

In the illustrated machine 10, an original 12 to be copied is placed upon a transparent support platen 14 fixedly arranged in an illumination assembly indicated generally by the reference numeral 16. While upon the platen, the illumination assembly flashes light rays upon the original, thereby producing image rays corresponding to the informational areas on the original. The image rays are projected by means of an optical system 18 to an exposure station 20 for exposing the surface of a moving xerographic plate in the form of a flexible photoconductive belt or photoreceptor 22. In moving in the direction indicated by the arrow, prior to reaching the exposure station 20, that portion of the belt being exposed would have been uniformly charged to approximately +900 volts by a corona generating device 24 located at a belt run extending between belt supporting rollers 26 and 28. The exposure station extends between the roller 28 and a third roller 30.

The exposure of the photosensitive surface of the belt to the light image discharges the surface in the areas struck by light whereby an electrostatic latent image remains on the belt in image configuration corresponding to the light image projected from the original on the support platen. As the belt continues its movement, the latent image passes around the roller 30 and through a developing station 32 where a developing apparatus indicated generally by the reference numeral 34 is positioned. The developing apparatus 34 comprises a plurality of magnetic brushes 36 which carry developer to the surface of the upwardly moving belt 22. Magnetic brushes are well known in the art, each such brush including stationary magnets located within a non-magnetic conductive sleeve or cylinder, the latter being electrically biased to a value slightly above the background potential on the photoreceptor. As developer is applied to the belt, toner particles in the development material are electrostatically attracted to the charged photosensitive surface to form a powder image (a developed electrostatic image).

The developed electrostatic image is transported by the belt 22 to a transfer station 38 where a sheet of paper is moved at a speed in synchronism with the moving belt in order to effect transfer of the developed image. Located at the transfer station 38 is a transfer roll 40 which is arranged on the frame of the machine to contact the back side of the sheet of paper as the latter is moved or fed between the belt and the transfer roll. The roll 30 is electrically biased with sufficient voltage so that the developed image on the belt may be electrostatically attracted to the adjacent side of a sheet of paper as the latter is brought into contact therewith. The transfer is initiated by the transfer roll 40, but is completed by a corona generating device 42.

A suitable sheet transport mechanism transports sheets of paper seriatim from a paper handling mechanism indicated generally by the reference numeral 44 to the developed image on the belt as the same is carried around the roller 26. In passing from the paper handling mechanism to the transfer roll 40, each sheet contacts a plurality of registration fingers 46.

As a sheet emerges from the transfer station 38, a charge is deposited thereon by a detack corona generating device 48 to lessen the electrostatic attraction between the belt 22 and the sheet so that the latter can be removed by a vacuum stripping and transport mechanism 50. The sheet is thereafter retained on the underside of the vacuum stripping transport mechanism 50 for movement into a fuser assembly indicated generally by the reference numeral 52 wherein the powder image on the sheet is permanently affixed thereto. After fusing, the finished copy is discharged at a suitable point for collection. The toner particles remaining as residue on the belt 22 are carried by the belt to a cleaning apparatus 54. The cleaning apparatus 54 comprises a corona discharge device 56 for neutralizing charges remaining on the untransferred toner particles, a rotating brush 58 mounted within a housing 60, and a vacuum outlet 62.

The developing apparatus 34 includes a sump 64 for containing developer, and developer is transported from the sump to the photoreceptor by the magnetic brushes 36. Depleted developer is returned by gravity to the sump from the uppermost magnetic brush, the developer being directed by guide plate 66 to a screen 68. A portion of the developer impacting the screen 68 passes through the screen and through a sensor 70. The sensor and control means are thoroughly described in U.S. Pat. No. 3,727,065 assigned to Xerox Corporation, the disclosure of this patent being incorporated by reference herein. As described above, however, the sensor 70 includes two elements for sensing toner density, the sensor and control means actuating a toner dispenser 72 when the density falls below a predetermined value. Upon actuation of the toner dispenser, a foam roll 74 rotates to dispense toner into the sump 64.

To overcome this problem described above, i.e., clogging of the screen 68 by developer, an AC operated coil 76 is connected to the screen. When the coil 76 is energized, a spring steel armature buzzes and causes the screen to vibrate which inhibits any buildup of developer on the screen. A second order of vibration is transmitted from the coil to the sensor 70 to insure that the orifice therethrough remains clear so that a constant flow of developer can pass through the sensor. A suitable AC coil for this purpose is a BU Series 120 volt, 1250 ohm coil manufactured AMF, Potter & Brumfield.

While the invention has been described with reference to the structure disclosed, it is not confined to the details set forth, but is intended to cover such modifications or changes as may come within the scope of the following claims.

What is claimed is:

1. An improved developing apparatus for developing an electrostatic latent image on a photoreceptor, the developing apparatus including a developer housing defining a sump for containing developer comprising carrier beads and toner particles, a toner dispenser for periodically dispensing toner into the sump, a sensor for controlling the operation of the toner dispenser, a screen located above the sensor, means for transporting developer from the sump to the photoreceptor to develop the latent image, and means for directing at least a portion of the developer from the transporting means through the screen to the sensor before being returned to the sump, the improvement comprising:

means for vibrating the screen to prevent developer from clogging the screen.

2. An improved developing apparatus as set forth in claim 1 wherein the vibrating means is an AC coil.

* * * * *